US005609014A

United States Patent [19]

Obara et al.

[11] Patent Number: 5,609,014

[45] Date of Patent: Mar. 11, 1997

[54] RUBBER REINFORCING STEEL CORD

[75] Inventors: Tamio Obara; Kazuo Matsumaru, both of Iwate-ken, Japan

[73] Assignee: Tokyo Rope Manufacturing Co., Ltd., Tokyo, Japan

[21] Appl. No.: 581,982

[22] Filed: Jan. 2, 1996

Related U.S. Application Data

[63] Continuation-in-part of Ser. No. 322,954, Oct. 13, 1994, abandoned, which is a continuation of Ser. No. 048,426, Apr. 14, 1993, abandoned.

[30] Foreign Application Priority Data

Apr. 20, 1992 [JP] Japan ..... 4-126754

[51] Int. Cl.[6] ..... D02G 3/36

[52] U.S. Cl. ..... 57/212; 57/902

[58] Field of Search ..... 57/200, 207, 210, 57/212, 223, 311, 902

[56] References Cited

U.S. PATENT DOCUMENTS

| | | | |
|---|---|---|---|
| 3,358,435 | 12/1967 | Peene et al. | 57/145 |
| 4,333,306 | 6/1982 | Yamashita et al. | 57/206 |
| 4,938,015 | 7/1990 | Kinoshita | 57/200 |
| 4,986,327 | 1/1991 | Takahira | 57/212 |
| 5,162,067 | 11/1992 | Miyawaki | 152/451 |
| 5,223,060 | 6/1993 | Imamiya et al. | 152/451 |
| 5,351,470 | 10/1994 | Shinmura | 57/902 |
| 5,410,868 | 5/1995 | Sakon | 57/902 |
| 5,473,878 | 12/1995 | Hamiel et al. | 57/902 |

FOREIGN PATENT DOCUMENTS

| | | |
|---|---|---|
| 153004 | 5/1932 | Switzerland . |

*Primary Examiner*—William Stryjewski
*Attorney, Agent, or Firm*—Nields & Lemack

[57] ABSTRACT

The steel cord has the 1×9 structure, in which three core wires and six thicker outer wires are twisted in the same direction with the same pitch, and has a flat shape in the section which is taken perpendicularly to the longitudinal section thereof. The six outer wires having at least two gaps between adjacent ones and the core wires have at least one gap between adjacent ones.

8 Claims, 3 Drawing Sheets

FIG.1-A
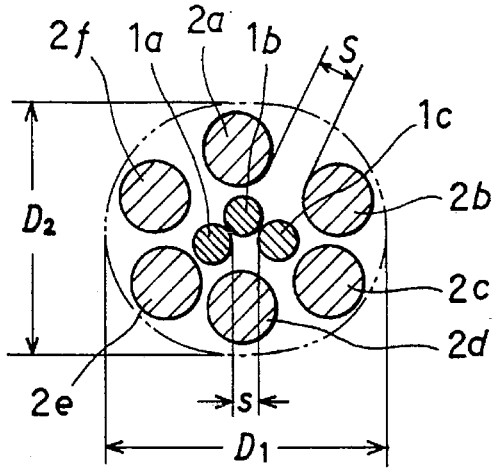
FIG.1-B
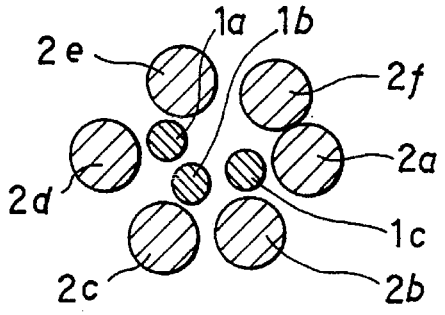
FIG.1-C
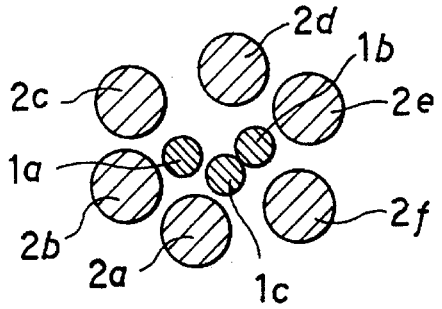
FIG.1-D
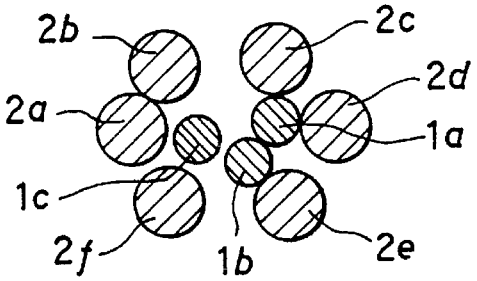

RUBBER REINFORCING STEEL CORD

This is a Continuation-In-Part of U.S. Ser. No. 08/322,954 filed on Oct. 13, 1994 (abandoned), which is a Continuation of U.S. Ser. No. 08/048,426 filed on Apr. 14, 1993 (abandoned).

BACKGROUND OF THE INVENTION

1. Field of the Invention

The present invention relates to steel cords to be used for reinforcing articles of rubber or the like and, more particularly, to steel cords composed of nine wires or filaments.

2. Description of the Prior Art

Rubber articles such as radial tires, conveyor belts or hoses for high pressure use steel cords as their reinforcing materials. In the prior art, one type of steel cord has the "3+6 structure" consisting of a center core and an outer jacket, as shown in FIG. 4. This structure is disclosed in U.S. Pat. No. 3,858,435.

In this steel cord having the 3+6 structure, around a center core (or strand) 100 having three wires or filaments (as will be shortly referred to as the "wires") twisted, there is arranged and twisted an outer jacket (or strand) 200 having six wires. This 3+6 type steel cord is classified depending upon the twisting direction into the opposite direction type and the uni-direction type. In the former type, the center core is twisted in the lefthand (or righthand) lay, and the outer jacket is twisted in the righthand (or lefthand) lay. In the latter type, both the center core and the outer jacket are twisted in the lefthand (or righthand) lay.

In either type, however, the 3+6 type steel cord has to be manufactured at two steps, i.e., the core stranding step and the outer closing step. This necessity drops the productivity and raises the production cost. Especially, the steel cord of the opposite direction type is encountered by a phenomenon that the center core is twisted back at the outer closing step. This makes it necessary to twist the center core with a shorter pitch than that of the final cord product. Thus, the steel cord of the opposite direction type is defective in the lower production efficiency.

In the 3+6 type steel cord, moreover, the three wires composing the center core 100 are in contact with one another so that a gap E having a closed section is established in the cord center, as shown in FIG. 4. This makes it impossible for the rubber material to impregnate into the center core thereby to leave the gap E as it is, when the cord and the rubber are to be combined. As water steals into the gap E when the rubber product is used, the corrosion of the center core advances to invite a problem that the fatigue resistance of the cord is deteriorated by the wear of fretting.

The steel cord of the uni-direction type has its two layers twisted in the same direction so that the retaining force (or fastening force) of the outer jacket for the center core is weak. As a result, when the steel cord of this type is used as the tire reinforcing material, there arises a problem that the center core is displaced to come out of the cord end by the repeated compressions or tensile bendings. As countermeasures for preventing the center core from coming out, it is conceivable to make the so-called "open structure", in which the adjacent ones of the three wires or filaments composing the center core are kept away from contacting with each other. However, the center core is twisted twice, that is, once at the core stranding step in the lefthand (or righthand) lay into an open structure and then at the outer closing step in the lefthand (or righthand) lay. This relation makes the center core into the so-called "tight structure", in which the center core has a short twisting pitch so that the wires or filaments come into contact with each other. This makes it practically unexpectable to prevent the core from coming out.

Incidentally, in a known multi-layer twisted steel cord, a number of wires or filaments are twisted all at once, as in the bunched type having the 1×12 structure or the 1×27 structure. This bunched type steel cord is advantageous in its excellent production efficiency because it can be manufactured by the single twisting step.

By applying this concept, therefore, it can be conceived to make a cord having nine wires from the cord having the 3+6 structure into the cord having the 1×9 structure. However, the cord, which is manufactured merely by preforming and twisting the nine wires, cannot still solve the problem that the three wires corresponding to the center core are liable to come out, because the three wires at the center are in linear contact with the surrounding six wires. Since, moreover, the three wires corresponding to the center core are in close contact with each other, the rubber penetration is still insufficient and cannot be released from the problem of deteriorating the fatigue resistance.

In the two-layered steel cord having the 3+6 structure or the 1×9 structure, moreover, the torsion is balanced between the torque (as will be referred to as the "residual torsion") of the center core and the torque of the outer jacket. The steel cord having the 1×9 structure has a far higher residual torsion at its center core than that of the 3+6 structure. In case, therefore, the steel cord and the rubber are combined into a sheet article, the residual torsion of the center core disappears at the cut face (or cord terminal) so that the wires of the outer jacket have a stronger torque. As a result, the combined sheet article exhibits flatness in the regions apart from the cut face but a rise at one end in the vicinity of the cut face. If, on the contrary, the torsion is set to flatten the region near the cut face, the regions apart from the cut face get warped, as indicated at Z (having a height of 6 to 10 mm) as shown in FIG. 5. This warp of the sheet article will cause disadvantages in the sizing accuracy at subsequent cutting (bias-cutting) and jointing steps.

SUMMARY OF THE INVENTION

The present invention has been conceived to solve the above-specified problems and has an object to provide a rubber reinforcing practical steel cord which can have excellent rubber penetration and fatigue resistance while being free from any come-out of its center core, which can have an excellent flatness when combined into a sheet article and which can be manufactured efficiently at a reasonable cost.

In order to achieve the aforementioned object, according to the present invention, there is provided a steel cord for reinforcing a rubber article or the like, comprising nine wires twisted in a common direction and with a common pitch and composed of three wires forming a center core and six wires forming an outer jacket and having a larger diameter than that of the three center core wires, wherein the improvement resides: in that the steel cord has a flat shape in the section taken perpendicularly to the longitudinal direction thereof; in that the six outer wires surround the three core wires and have at least two gaps (S) between their adjacent ones; and in that the three core wires have at least one gap (s) between their adjacent ones.

The flat section preferably has a longer diameter and a shorter diameter at a ratio of 1.05 to 1.20. It is also preferable that an elongation is 0.090 to 0.125 when a load of 0→5 Kg is applied thereto.

The outer wires and the core wires have diameters no more than 0.5 mm, and the outer wires have a diameter 1.5 to 2.0 times the diameter of the core wires.

According to the present invention, the steel cord can be manufactured at one step to reduce the cost because the nine wires are twisted all at once.

On the other hand, the mere twisting the nine wires will provide the compact type or closed type sectional shape. Since, however, the cord is flattened in its entirety, the three core wires and the six outer wires are formed into the open structures so that the rubber can sufficiently penetrate into the gaps between the outer wires and between the core wires, thus improving the fatigue resistance.

On the other hand, the bunched type ordinary cord has its wires twisted in the same direction and with the same pitch so that the core wires and the outer wires come into linear contact so that the three core wires corresponding to the center core are liable to come out. In the present invention, however, the cord is given the flattened section so that the torsion such as the residual torsion of the three core wires is suppressed to prevent the so-called "come-out" of the center core.

As described above, the bunched type cord has a high residual torsion in the three core wires corresponding to the center core so that the residual torsion is released at the cut face of the sheet article. According to the present invention, however, the torsion of the core wire is suppressed to eliminate the phenomenon of the release of the residual torsion so that the flatness of the sheet is improved.

Especially in case the ratio of the longer diameter to the shorter diameter is set at 1.05 to 1.20, the aforementioned rubber penetration is improved to stabilize the contact balance between the core wires acting as the elements for suppressing the release of the residual torsion and the outer wires. Since, moreover, the dispersion of the size of the longer diameter is reduced, the dispersion of the fatigue resistance can be reduced to suppress an excessive elongation in a low load range.

BRIEF DESCRIPTION OF THE DRAWINGS

FIGS. 1-A to 1-D are sections showing the four fifths pitch of a steel cord according to the present invention;

DESCRIPTION OF THE PREFERRED EMBODIMENTS

Figure 2:
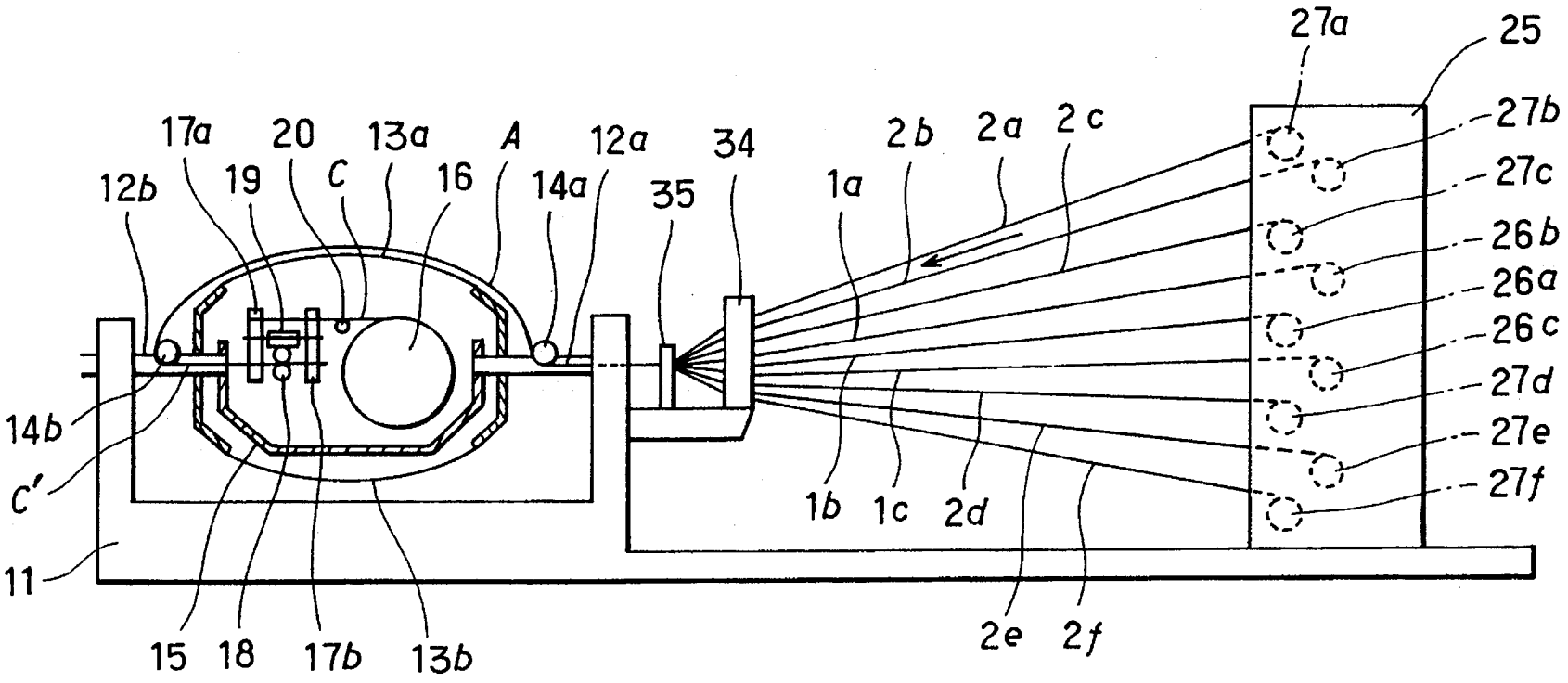
FIG. 2 is an explanatory diagram schematically showing an apparatus for manufacturing the steel cord of the present invention.

The present invention will be described in the following in connection with its embodiments with reference to the accompanying drawings.

FIGS. 1-A to 1-D present sections of the four fifths pitch of a rubber reinforcing steel cord according to the present invention.

Reference numerals 1*a*, 1*b* and 1*c* designate three core wires, and numerals 2*a*, 2*b*, 2*c*, 2*d*, 2*e* and 2*f* designate six outer wires. The individual core wires 1*a* to 1*c* are made to have an equal diameter. And, the individual outer wires 2*a* to 2*f* are made to have an equal diameter, which is 1.5 to 2.0 times the diameter of the core wires 1*a* to 1*c*.

Both the core wires 1*a* to 1*c* and the outer wires 2*a* to 2*f* are made of steel wires having a diameter of no more than 0.5 mm, preferably 0.15 to 0.38 mm and have their outer circumferences plated with brass. These steel wires may be identical in the chemical composition between the core wires and the outer wires, or only the outer wires may be high-carbon wires having a higher carbon content.

The three core wires 1*a* to 1*c* and the six outer wires 2*a* to 2*f* described above are simultaneously twisted in the same direction and with the same pitch to construct the 1×9 structure. The twisting pitch may preferably be 10 to 20 mm. The cord has its outer circumference wound, if desired, with a wrapping wire.

Moreover, the steel cord of the present invention is flattened in its entirety at the section taken perpendicularly to the longitudinal direction. Between the adjoining ones of the side outer wires 2*a* to 2*f*, there are formed a plurality of gaps S in every sections taken by the length of one pitch. At least one gap s is also formed between the adjacent ones of the core wires 1*a* to 1*c*.

The ratio of the aforementioned flatness may preferably be within a range of $D_1/D_2$ Of 1.05 to 1.20 if the longer diameter has a size of $D_1$ whereas the shorter diameter has a size of $D_2$, as shown in FIG. 1. In the physical properties, on the other hand, an elongation should be within a range of 0.090 to 0.125 when a load of 0→5 Kg is applied.

The reasons for the limits of the range will be described in the following. The lower limit of the elongation to 0.090 for the load application of 0→5 Kg is decided because no gap is formed to eliminate the rubber penetration if the elongation is less than the lower limit. The upper limit of 0.125 is decided because the cord is excessively opened to allow the center core to come out disadvantageously, if the elongation exceeds the upper limit.

On the other hand, the reason for setting the lower limit of the ratio $D_1/D_2$ to 1.05 will be described in the following. If this lower limit is exceeded, the aforementioned gaps S and s may be narrowed or formed in only one portion. Especially as to the core wires 1*a* to 1*c*, there may appear regions, in which all the core wires come into contact in a longitudinal section, so that the rubber penetration becomes inferior in some portions to drop the fatigue resistance.

Figure 4:
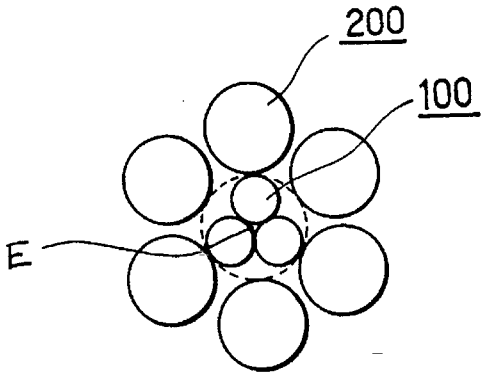
FIG. 4 (PRIOR ART)
FIG. 4 is a section showing the multi-layered steel cord of the prior art.

In ease the ratio $D_1/D_2$ is below 1.05, moreover, the sectional shape formed by the three core wires 1*a* to 1*c* may fall to be flattened so that it resembles that of the center core of the ease of the 3+6 structure of FIG. 4. Then, the core wires 1*a* to 1*c* become liable to be twisted all together thereby to come out.

Moreover, the release of the residual torsion of the core wires 1*a* to 1*c* is suppressed by the balance of the contacting portions between the core wires 1*a* to 1*c* and the outer wires 2*a* to 2*f*. If the ratio $D_1/D_2$ is below 1.05, the balance will be unstable so that the residual torsion of the core wires 1*a* to 1*c* will be released at the terminal of the cord. As a result, the cut face of the rubber sheet is flattened at the minus side so that the sheet is warped, as described above, to deteriorate the flatness of the sheet.

On the other hand, the reason for setting the upper limit of the ratio $D_1/D_2$ is as follows. If the ratio $D_1/D_2$ exceeds 1.20, the aforementioned gaps S and s are sufficiently retained to provide an excellent rubber penetration. Moreover, the torsions of the core wires 1*a* to 1*c* are suppressed to prevent them from coming out. Despite of these advantages, however, the balance at the connecting portions between the core wires 1*a* to 1*c* and the outer wires 2*a* to 2*f* becomes unstable so that the residual torsion of the core wires becomes liable to leave the cord terminal end thereby to make the flatness of the sheet unstable.

Moreover, if the flatness ratio $D_1/D_2$ exceeds 1.20, the preforming dispersion of the six outer wires increases so much that the improvement in the fatigue resistance cannot be expected. In addition, the flatness ratio has such a relation to the elongation that the elongation in a low load range will increase with the increase of the flatness ratio. As a result, the tension control may become difficult at the calendering treatment, or the cut end portion of the cord has its twist disturbed.

The flatness ratio can satisfy, if within the aforementioned range, all the conditions, i.e., the rubber penetration, the fatigue resistance, the prevention of the come-out of the core and the sheet flatness.

Here will be described a method of manufacturing the aforementioned steel cord of the present invention. Nine wires are let off at first. Before the twisting step, the core wires 1*a* to 1*c* and the outer wires 2*a* to 2*f* are preformed in advance to an extent exceeding 100% and are then twisted. The 1×9 cord thus twisted to have the open structure is flattened by means of forming rollers before it is taken up.

Figure 3:
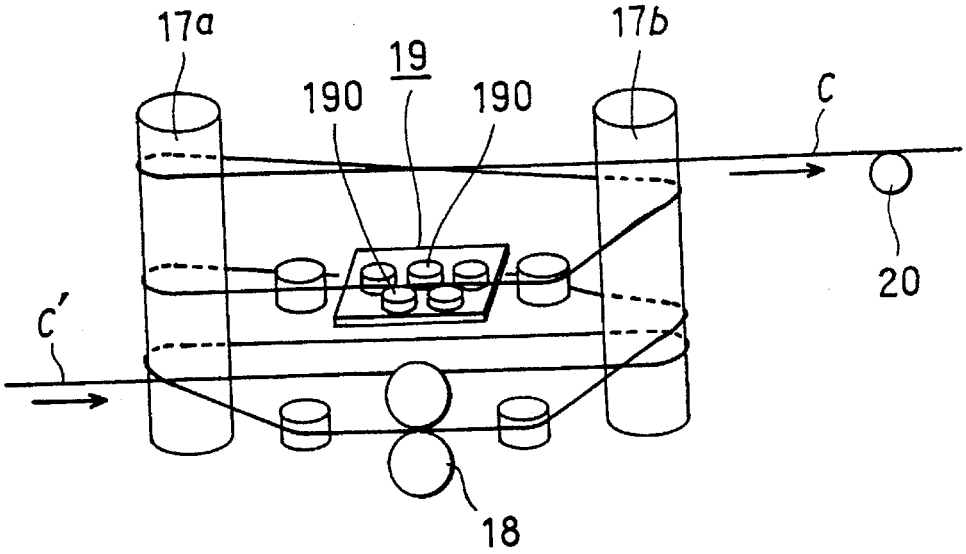
FIG. 3 is a perspective view showing a construction of the inside of a cradle of FIG. 2.

FIGS. 2 and 3 show an apparatus For manufacturing the steel cord of the present invention. Designated at reference numeral 11 is a frame, in which are rotatably mounted hollow spindles 12*a* and 12*b*. Loops 13*a* and 13*b* are extended between the end portions of those hollow spindles 12*a* and 12*b*. A first turn roll 14*a* is attached to one hollow spindle 12*a* whereas a second turn roll 14*b* is attached to the other hollow spindle 12*b*.

Designated at numeral 15 is a cradle which is disposed between the end portions of the hollow spindles 12*a* and 12*b* inside of the aforementioned loops 13*a* and 13*b*. The cradle 15 is so supported rotatably relative to the hollow spindles 12*a* and 12*b* that it can hold a predetermined position independently of the rotations of the hollow spindles 12*a* and 12*b*. This cradle 15 is equipped therein with a take-up bobbin 16, a pair of capstans 17*a* and 17*b*, an overtwister 18, a forming roll unit 19 and a traverser 20.

Designated at numeral 25 is a wire supply unit having nine wire bobbins, of which the central three bobbins 26*a* to 26*c* are wound with the individual center wires 1*a* to 1*c* whereas the remaining six bobbins 27*a* to 27*f* are wound with the individual side wires 2*a* to 2*f*.

The aforementioned frame 11 is equipped with a twisting die 35 upstream of the hollow spindle 12*a* and a preforming device 34 of three-pin type upstream of the twisting die 35.

The individual wires let off from the aforementioned nine wire bobbins 26*a* to 26*c* and 27*a* to 27*f* are passed through the preforming device 34 and introduced from the twisting die 35 via the hollow spindle 12*a*, the first turn roll 14*a*, the loop 13*a*, the hollow spindle 12*b* and the second turn roll 14*b* into the cradle 15. The wires are then extended between the capstans 17*a* and 17*b* and through the overtwister 18 and the forming roll unit 19 until they are taken up through the traverser 20 by the take-up bobbin 16.

In this state, the hollow spindles 12*a* and 12*b* rotate to revolve the turn rolls 14*a* and 14*b* and the loops 13*a* and 13*b* at a constant speed on the axis of rotation of the hollow spindles 12*a* and 12*b*. At last, a wire bundle A is sequentially extracted by the capstans 17*a* and 17*b* until it is let off from the wire bobbins 26*a* to 26*c* and 27*a* to 27*f*.

The core wires 1*a* to 1*c* let off from the bobbins 26*a* to 26*c* and the outer wires 2*a* to 2*f* let off from the bobbins 27*a* to 27*f* are excessively preformed in the preforming device 34.

The core wires 1*a* to 1*c* and the outer wires 2*a* to 2*f* thus excessively preformed are arranged, after passed through the twisting die 85, such that the three center wires 1*a* to 1*c* are positioned in the central region and surrounded by the six outer wires 2*a* to 2*f*, to provide the opened wire bundle A. This wire bundle A is then introduced into the hollow spindle 12*a* and firstly twisted through the first turn roll 14*a* and is doubly twisted from the loop 13*a* to the second turn roll 14*b*. Thus, there is prepared a coarse steel cord C' of the open structure having a predetermined pitch and having its core wires and outer wires opened.

The coarse steel cord C' having passed through the second turn roll 14*b* is introduced via the capstans 17*a* and 17*b* into the overtwister 18, in which it is set to a predetermined torsion. After This, the steel cord C' comes into the forming roll unit 19. This forming roll unit 19 has a plurality of rolls 190 staggered to compress the coarse steel cord C' of the open structure positively thereby to deform the cord section plastically into a flat shape. The forming roll unit 19 is controlled to give the aforementioned flatness ratio by adjusting the extent of preforming the wire in the aforementioned preforming device 84. The object steel cord C thus flattened is taken up by the take-up bobbin 16.

EXAMPLES

Here will be presented in Table 1 the specific examples of the steel cord of the present invention and the results of testing the characteristics of the examples.

The core wires used were three steel wires plated with brass and having a diameter of 0.2 mm, and the outer wires used were six steel wires plated with brass and having a diameter of 0.35 mm. These wires were employed to manufacture a flattened steel cord of the 1×9 structure by the double twister shown in FIGS. 2 and 3.

For the preformation, the core wires and the outer wires were excessively preformed by the three-pin type preformer so that they were simultaneously twisted with a twisting pitch of 18 mm. These twisted core and outer wires were flattened by the forming roll unit before they were taken up. The adjustments of the flatness ratios of Samples 4 to 11 were carried out by changing the preforming extents of the preformer.

For comparison, a steel cord (Sample 3) was prepared to have a flatness ratio of 1.000 by using not the forming rolls but the ordinary correcting rolls. Separately of this, a steel cord (Sample 1) of the 3+6 structure was prepared at the two twisting steps, i.e., by twisting the center core in the right-hand lay and the outer jacket in the lefthand lay, and a steel cord (Sample 2) of the 3+6 structure was also prepared at the two twisting steps, i.e., by twisting both the center core and the outer jacket in the lefthand lay.

Table 1 present the test results of the flatness ratio, the elongation under the load of 0→5 Kg, the come-out of the core, the sheet flatness, the rubber penetration (or air permeability) and the fatigue resistance of the steel cords of the aforementioned Samples 1 to 11. Incidentally, the core come-out was tested by the pull-out force method. Specifically, the cord was buried with a length of 80 mm in a rubber block, and this rubber block was vulcanized. Then, the force was determined by removing the outer wires at the one end of the cord, by grasping the core wires and by extracting the core wires while holding the rubber block. Comparisons of the core come-out were exponentially accomplished by assuming the test value of the Sample 1 at 100.

The fatigue resistance was tested by the method, in which the samples having their cords coated with rubber were chucked at their two ends and moved to the right and left a predetermined length through three rolls to determine the number of trials of cutting the cords. Comparisons of the fatigue resistance were exponentially accomplished by assuming the test value of the Sample 1 at 100.

Figure 5:
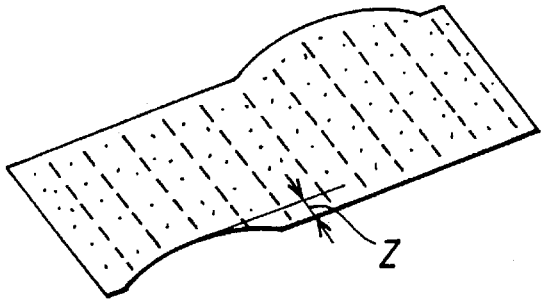
FIG. 5 (PRIOR ART)
FIG. 5 is an explanatory diagram showing the warping phenomenon of a rubber sheet in case the multi-layered steel cord of the prior art is used.

The sheet flatness was tested by means of the sheets which had been prepared by the drum winder. These tests were evaluated to ○, if the sheet had no abnormal rise (i.e., the phenomenon of FIG. 5), and to X if the abnormal rise occurred.

The rubber penetration was tested by arranging a composite having a rubber coating and a length of 25.4 mm in a pressure container in water, by introducing air under a pressure of 0.5 Kgf/cm$^2$ into the container, and by metering the amount of air leaking in the axial direction from the composite. The metered values are exponentially tabulated by assuming the test value of the Sample 3 at 100.

TABLE 1

| Sample | ① | ② | ③ | ④ | ⑤ | ⑥ | ⑦ | ⑧ |
|---|---|---|---|---|---|---|---|---|
| 1 | 3 + 6 | — | 0.071 | 100 | ○ | 5 | 100 | Z: 9.5<br>S: 18.0 |
| 2 | 3 + 6 | — | 0.080 | 99 | ○ | 10 | 88 | S: 9.5<br>S: 18.0 |
| 3 | 1 × 9 | 1.000 | 0.069 | 63 | × | 100 | 92 | S: 18.0 |
| 4 | 1 × 9 | 1.044 | 0.081 | 92 | × | 8 | 97 | S: 18.0 |
| 5 | 1 × 9 | 1.057 | 0.096 | 100 | ○ | 3 | 110 | S: 18.0 |
| 6 | 1 × 9 | 1.114 | 0.107 | 100 | ○ | 1 | 107 | S: 18.0 |
| 7 | 1 × 9 | 1.157 | 0.116 | 100 | ○ | 1 | 110 | S: 18.0 |
| 8 | 1 × 9 | 1.192 | 0.121 | 100 | ○ | 1 | 108 | S: 18.0 |
| 9 | 1 × 9 | 1.215 | 0.129 | 99 | × | 1 | 101 | S: 18.0 |
| 10 | 1 × 9 | 1.248 | 0.138 | 86 | × | 0 | 103 | S: 18.0 |
| 11 | 1 × 9 | 1.262 | 0.145 | 67 | × | 0 | 96 | S: 18.0 |

In Table 1:
①: Cord Structure;
②: Flatness Ratio;
③: Elongation (%);
④: Core Come-out;
⑤: Sheet Flatness;
⑥: Air Permeability;
⑦: Fatigue Resistance; and
⑧: Twisting Direction and Pitch (mm),
Z: Righthand Lay; and
S: Lefthand Lay As could be apparent from Table 1, the Samples 5, 6, 7 and 8 within the scope of the present invention are satisfactory in all the characteristics including the elongation, the sheet flatness, the rubber penetration and the fatigue resistance. On the other hand, the Sample 1 is inferior to the present invention in the rubber penetration and the fatigue resistance, and the Sample 2 is also inferior in the rubber penetration and the fatigue resistance. Although the Sample 3 can be manufactured at the single step, it is rather inferior to the Sample 1 in the core come-out, the rubber penetration and the fatigue resistance and is insufficient in the sheet flatness because it is not flattened. Moreover, the Sample 4 having a flatness ratio lower than the lower limit of the present invention is also inferior in the characteristics to the Sample 1. The Samples 9, 10 and 11 having their flatness ratios exceeding the upper limit of the present invention have excessive elongations and insufficient sheet flatnesses. Moreover, their fatigue resistances are also equivalent or inferior tothat of the Sample 1.

What is claimed is:

1. A steel cord for reinforcing a rubber article or the like, comprising nine wires twisted in a common direction and with a common pitch and composed of three wires forming a center core and six wires forming an outer jacket and having a larger diameter than that of said three center core wires, wherein the improvement resides: in that said steel cord has a flat shape in the section taken perpendicularly to the longitudinal direction thereof; in that said six outer wires surround said three core wires and have at least two gaps (S) between their adjacent ones; and in that said three core wires have at least one gap (s) between their adjacent ones, wherein said flat section has a longer diameter $D_1$ and a shorter diameter $D_2$ at a ratio of $D_1/D_2$ of 1.05 to 1.20.

2. A steel cord according to claim 1, wherein the elongation is in the range of 0.090 to 0.125% when a load increasing from 0 to 5 Kg is applied thereto.

3. A steel cord according to claim 1 or 2, wherein said outer wires and said core wires have diameters no more than 0.5 mm, and wherein said outer wires have a diameter 1.5 to 2.0 times the diameter of said core wires.

4. A steel cord according to claim 3, wherein the twisting pitch is 10 to 20 mm.

5. A steel cord according to claim 3, wherein it is manufactured by preforming said core wires and said outer wires so as to have a diameter greater than that of a cord formed by tightly twisting said wires by twisting said nine wires into a coarse steel cord C' having an open structure, and by compressing said steel cord C' positively by means of a forming roll unit.

6. A steel cord according to claim 5, wherein it is manufactured by preforming said core wires and said outer wires so as to have a diameter greater than that of a cord formed by tightly twisting said wires by twisting said nine wires into a coarse steel cord C' having an open structure, and by compressing said steel cord C' positively by means of a forming roll unit.

7. A steel cord according to claim 1 or 2, wherein the twisting pitch is 10 to 20 mm.

8. A steel cord according to claim 1 or 2, wherein it is manufactured by preforming said core wires and said outer wires so as to have a diameter greater than that of a cord formed by tightly twisting said wires by twisting said nine wires into a coarse steel cord C' having an open structure, and by compressing said steel cord C' positively by means of a forming roll unit.

* * * * *